US007160427B2

(12) United States Patent
Fournier et al.

(10) Patent No.: US 7,160,427 B2
(45) Date of Patent: Jan. 9, 2007

(54) IN SITU PLATING OF ELECTRICAL CONNECTOR CONTACTS

(75) Inventors: Joel Fournier, Verdun (CA); Danielle Miousse, Ste-Julie (CA); Jean-Marc Limoges, Richelieu (CA); Serge Lalancette, Ste.Julie (CA); David Arseneault, Greenfield Park (CA)

(73) Assignee: Pratt & Whitney Canada Corp., Longueuil (CA)

( * ) Notice: Subject to any disclaimer, the term of this patent is extended or adjusted under 35 U.S.C. 154(b) by 216 days.

(21) Appl. No.: 10/893,552

(22) Filed: Jul. 19, 2004

(65) Prior Publication Data

US 2006/0013961 A1 Jan. 19, 2006

(51) Int. Cl.
*C25D 5/06* (2006.01)

(52) U.S. Cl. ..... 205/117; 205/115; 205/122

(58) Field of Classification Search ..... 205/115, 205/117

See application file for complete search history.

(56) References Cited

U.S. PATENT DOCUMENTS 3,616,283 A 10/1971 Magee et al.
3,616,285 A * 10/1971 Norris ..... 205/115
3,658,663 A 4/1972 Fukanuma et al.
3,698,083 A 10/1972 Schrek
4,119,499 A * 10/1978 Eidschun, Jr. ..... 205/50
4,159,934 A * 7/1979 Kadija ..... 204/224 R
4,280,882 A 7/1981 Hovey
4,655,881 A * 4/1987 Tezuka et al. ..... 205/104
5,190,486 A 3/1993 Tsuk
5,342,992 A 8/1994 Noto
5,397,598 A 3/1995 DiPaolo et al.
5,448,016 A 9/1995 DiPaolo et al.
5,516,416 A 5/1996 Canaperi et al.
5,580,432 A * 12/1996 Shibata et al. ..... 204/297.1
6,051,119 A 4/2000 Findeis et al.
6,203,690 B1 3/2001 Findeis et al.
6,364,671 B1 4/2002 Verneau
6,497,805 B1 * 12/2002 Lake et al. ..... 205/96
6,527,935 B1 3/2003 Lopergolo et al.

* cited by examiner

*Primary Examiner*—Roy King
*Assistant Examiner*—William T. Leader
(74) *Attorney, Agent, or Firm*—Ogilvy Renault LLP

(57) ABSTRACT

A method of plating contacts in situ within an electrical connector, the connector having a plurality of contacts circumscribed by a skirt of a connector body. The method comprises. grounding the contacts and then applying a plate coating onto the contacts within the connector body.

16 Claims, 3 Drawing Sheets

IN SITU PLATING OF ELECTRICAL CONNECTOR CONTACTS

TECHNICAL FIELD

The invention relates generally to refurbishment of electrical connectors and, more particularly, to refurbishment of the plating on pin contacts in electrical connectors.

BACKGROUND OF THE ART

Electrical wires or communication cables, especially those of an industrial grade, typically use connector plugs to interconnect. a cable or wire to another cable, and/or to a source or destination of the transmitted electrical current or signal. Such electrical connectors often comprise pin contacts which are plated for improved performance. However, such plating on the pins tends to wear out with time and repeated use of the connector. When the plating on the pin contacts of such electrical connectors becomes worn or damaged, the connector itself, or the entire assembly of which they are a component, is discarded and replaced. An improved solution is desired.

SUMMARY OF THE INVENTION

It is therefore an object of this invention to provide a method of refurbishing pin contacts in situ within electrical connectors.

In one aspect, the present invention provides a method of plating contacts in situ within an electrical connector, the connector having a plurality of contacts provided at a base of a cavity defined within a connector body and circumscribed by a skirt thereof, the skirt extending from the base a greater distance than the contacts and defining an opening providing access to the cavity, the method comprising: inserting a grounding member into the cavity through the opening such that all of the contacts to be plated are interconnected in electrical flow communication by the grounding member; grounding the grounding member such that the contacts are commonly grounded; and applying a brush plated coating onto the contacts within the connector body.

In a second aspect, the present invention provides a method of plating contact pins of an electrical connector in situ therewithin, the connector having a plurality of contact pins provided at a base of a cavity defined within a connector body and circumscribed by a skirt thereof, the skirt extending from the base a greater distance than the contacts and defining an opening providing access to the cavity, the method comprising: inserting a grounding member into the cavity through the opening such that the grounding member interconnects the contact pins to be plated in electrical flow communication; linking in electrical flow communication a cathode of a brush plating system with the grounding member; attaching an anode of the brush plating system to a brush plating tool; and using the brush plating tool to apply a plate coating onto the contact pins within the connector body.

Further details of these and other aspects of the present invention will be apparent from the detailed description and Figures included below.

DESCRIPTION OF THE DRAWINGS

Reference is now made to the accompanying Figures depicting aspects of the present invention, in which.

DETAILED DESCRIPTION OF PREFERRED EMBODIMENTS

Figure 1:
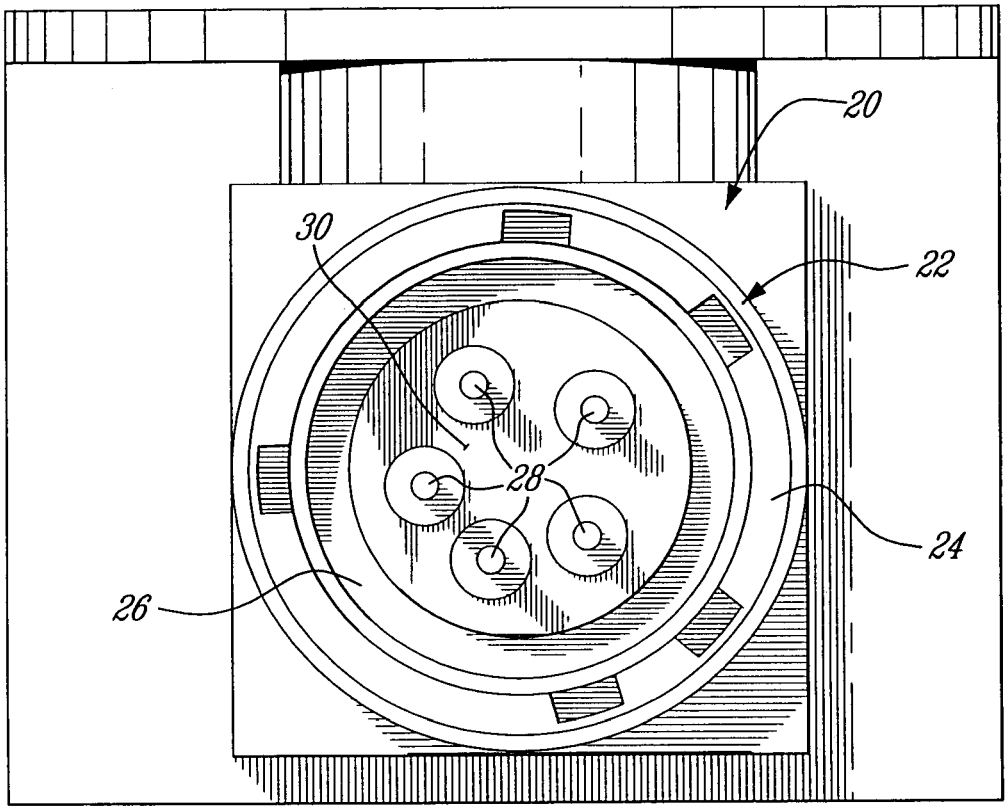
FIG. 1 is a top plan view of an electrical connector having plated pin contacts adapted to be refurbished in accordance with a method of the present invention.

Gas turbine engines typically employ a variety of surrounding accessories, such as electrical and/or hydraulic components, which require electrical communication cables, hydraulic lines and the like for communication between the accessory components and the engine itself. Such electrical communication cables, for example, are used to interconnect probes and sensors with an engine electronic controller (not shown). Electrical communication cables must be able to be readily engaged and disengaged when needed to allow installation and maintenance access to the accessory components and to the engine. Thus, plug-type electrical connectors are most often provided on the ends of such electrical communication cables to permit simple and efficient connection. and disconnection of the cables with the corresponding mating plugs of the engine or accessory component.

Plug-type electrical connectors are also used in many other applications in which electrical communication cables are employed, such as, but certainly not limited to, electrical power systems, audio-visual equipment, electronics, or electrical control systems for vehicles and industrial machinery. In all such applications, it is common to use a connector which includes a plurality of upstanding pin contacts, which are circumscribed by a surrounding skirt. Accordingly, the pins are protected from abuse when not connected with the mating portion of the connector plug.

Many pin contacts, especially those used for applications in which a high quality signal transmission is desired, are coated by a metallic plating which improves their conductivity and therefore quality of their signal transmission. As such, pin contacts are often coated with a gold plating. The gold plating, however, tends to degrade or become damaged over time, with repeated insertion and removal of the pin contacts of the connector with the mating sockets of the corresponding opposed connector, and/or as a result of severe environmental conditions, such as those to which all elements of gas turbine engines are exposed for example. The standard connector design noted above, wherein the pin contacts are provided within a connector body which includes a surrounding skirt, reduces the likelihood of the pins becoming bent or damaged, however it also makes the pin contacts difficult to access for maintenance or replacement. Particularly, re-plating of worn pin contacts becomes exceedingly difficult due to the limited space available to access them in situ within the connector body.

The present invention provides a method which enables such pin contacts in electrical connectors to be refurbished in situ within the surrounding connector body. This accordingly improves the ability to re-plate the pin contacts in situ, thereby making repair of connectors having worn pin contact plating more feasible and provides an economically viable alternative to simply discarding worn connectors (and/or the entire assembly of which they are a component) and replacing them with new ones. Thus, parts which were often previously declared unserviceable due to pin contact plating deterioration, can be salvaged by re-plating the pin contacts in situ within the connector body, without having to dismantle the connector.

A major difficulty in being able to plate the pin contacts in situ within the connector body is the limited accessibility of the pin contacts. Plating only a portion of the connector using a bath plating system is problematic without disassembly of the connector. In order to permit brush plating of the pin contacts, each must be grounded. Rather than having to ground each pin individually in turn before plating, the present invention permits all of the pin contacts to be electrically interconnected such that the plating operation can be performed without having to remove the connector unit from its assembly. This is achieved in situ, using a grounding member as will be described in further detail below. Thus, the pin contacts can be refurbished by re-plating them in situ within their connector body, without removing the connector from its assembly.

Brush plating is an electrochemical process used to apply a plate coating on relatively localized areas of parts, often which need coating for repair or dimensional restoration. Brush plating uses a brush tool containing an anode of the brush plating system to apply the plating solution to the workpiece. The workpiece is itself connected to a cathode of the brush plating system. The brush plating system also includes a rectifier which provides the direct current required for the plating process. However, in order to be able to brush plate a given component, it must be connected to the cathode of the brush plating system and therefore grounded. As such, each pin contact of an electrical connector would have to be individually grounded such that re-plating of that pin is possible. However, the confined space available within the connector typically makes grounding a single pin difficult or impossible. In order to eliminate this difficult step, therefore, the present invention provides a method for plating the pin contacts in situ within the connector body by electrically interconnecting all of the pin contacts together in a manner which is quickly achievable and which does not inhibit subsequent plating of the pin contact surfaces. As will be described in further detail below, this interconnection of all of the pin contacts is achieved by inserting a grounding member within the connector body to electrically interconnect all of the pin contacts together.

Figure 2:
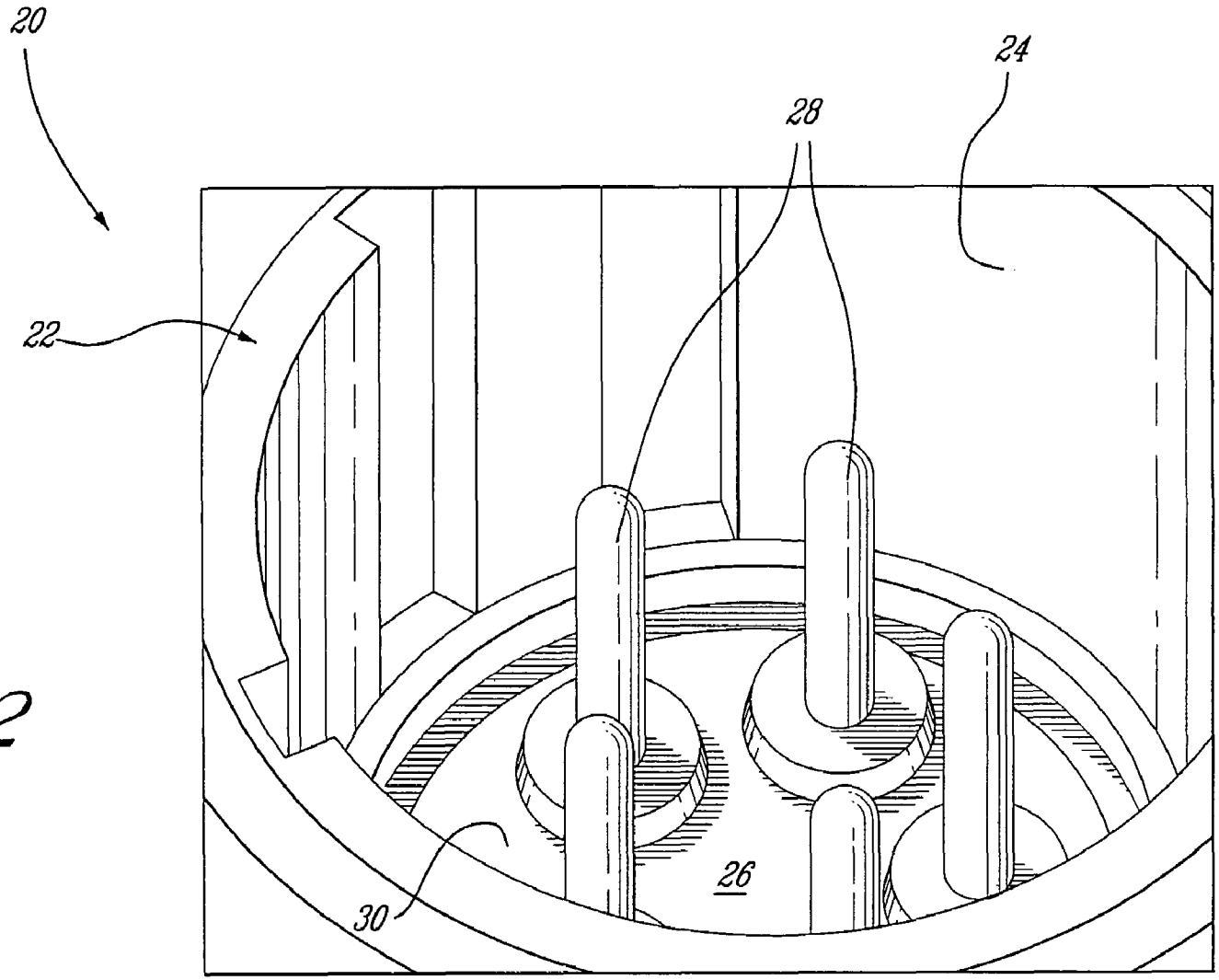
FIG. 2 is a detailed perspective view of the electrical connector of FIG. 2.

Referring to FIGS. 1 and 2, an electrical connector 20 includes a connector body 22 having an outer skirt portion 24 which defines an open cavity 26 therewithin. A plurality of pin contacts 28 are provided within the open cavity 26 and are circumscribed by the skirt portion 24. The outer skirt portion 24 of the connector body 22 extends from the base a greater distance that the pin contacts 28, such that the pin contacts are enclosed within the open-top cavity 26 defined within the skirt. Thus, the pin contacts 28 extend from the base 30 of the cavity, however do not extend beyond the outer skirt portion 24 of the connector body 22, which serves to mate with the corresponding female connector and to protect the pin contacts. such that their exposure to potential damage is limited. This skirt portion 24, however, also limits the accessibility of the pin contacts for the refurbishment process.

The method of the present invention will now be described. It will be understood that, in the case of the application of the present invention to already-plated connectors, suitable removal and cleaning steps may be required in advance of the following.

Figure 3:
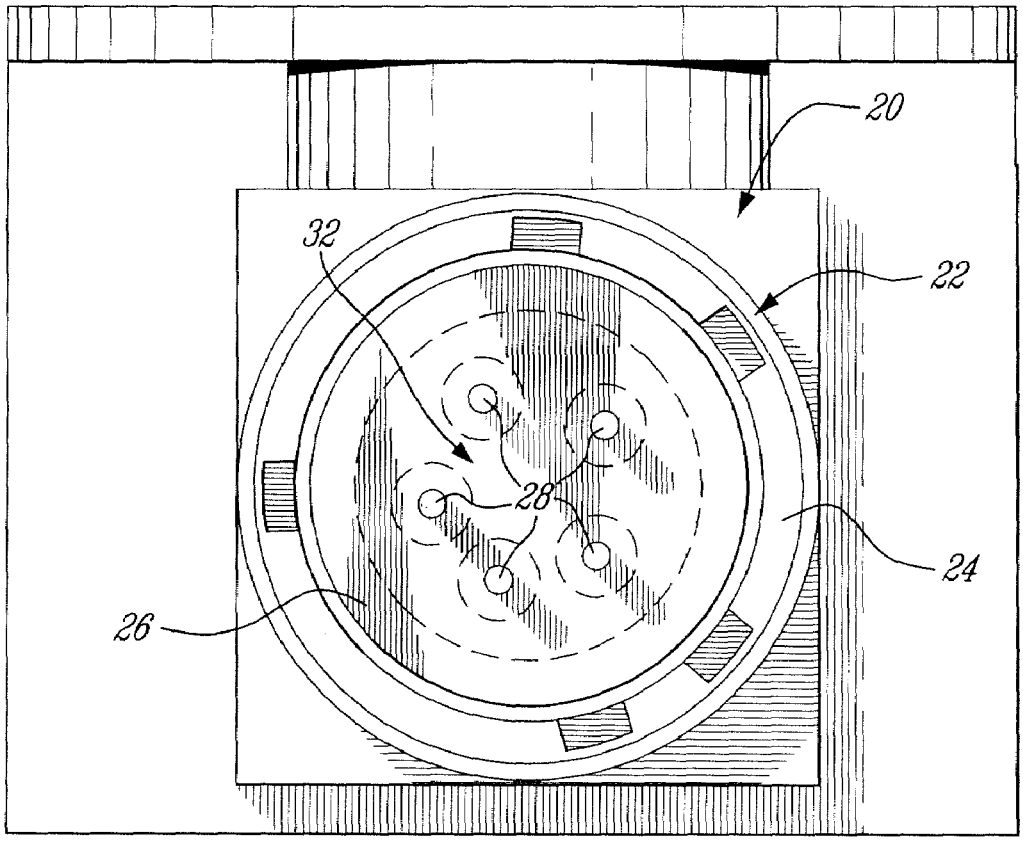
FIG. 3 is a top plan view of the electrical connector of FIG. 1, having a grounding member inserted therein.

Referring to FIG. 3, in order to successfully commonly ground all of the pin contacts a grounding member 32 is inserted into the cavity 26 defined within the skirt portion 24 of the connector body 22. Typically an interfacial seal (not shown) will require removal from the bottom of the cavity 26 before the grounding member is inserted, to ensure grounding occurs. The grounding member 32 is placed at the bottom of the cavity 26 in abutment with the base thereof, and in such a manner that all of the pin contacts 28 come into direct contact with the grounding member 32. Thus, the grounding member 32 disposed at the base 30 of the cavity preferably interconnects all of the pin contacts 28 (or, at least all those to be plated) in electrical communication with the connector body 22, while leaving their outer surfaces substantially exposed such that the plate coating can be re-applied thereon. In connectors where one or more pins are connected to the connector body 22, to achieve the mentioned communication grounding member 32 really need only connect the pins to one another, since the pin(s) connected to the connector body 22 will provide grounding. Thus, only the grounding member 32, or the connector body itself provided it is sufficiently electrically conductive and the grounding member 32 is disposed in contacting engagement therewith, need be connected with the cathode of the brush plating system and grounded. In one embodiment, the grounding member 32 is a thin foil sheet, which is sufficiently conductive to permit electrical flow communication between itself and the pin contacts 28. Preferably, three layers of foil are used, to ensure good conductivity, however the number of layers will vary depending on layer thickness, material, conductivity required, etc. Although other materials may be used, the grounding member 32 is preferably an aluminum foil provided with a shape which readily permits its insertion within the cavity of the connector body. As such, the holes defined within the foil sheet need not be provided in advance to correspond to the size and configuration of the pin contacts 28, but rather the relatively soft aluminum foil can be pressed overtop of the pin contacts, which perforate holes therein corresponding to the pins. Thus, the aluminum foil contacts at least the majority of the full circumference of each pin connector. Once perforated, the foil can be slid down the pin contacts and into the base of the connector body cavity, electrically interconnecting the pin contacts at their bases, but leaving a significant portion of their upper surfaces exposed for re-plating. The grounding member 32 also preferably abuts in contacting engagement with the connector body 22, thereby grounding all of the pin contacts with the connector body, however, as mentioned above, the grounding member 32 may not itself be required to contact body 22, if one (or more) of the pins do. As such, only the outer connector body need be grounded, obviating the need to individually ground each pin contact. If the outer connector body is not readily conductive, for example it is made of plastic, only the grounding member itself is connected directly to the cathode of the brush plating system.

Once the aluminum foil grounding member 32 is inserted in place as shown in FIG. 3, thereby connecting all of the pin contacts 28 in electrical communication with one another and with the outer connector body 22, the pin contacts may then be brush plated to re-apply a new plate coating thereon. A brush plating system is accordingly provided having generally a rectifier/power source, an anode and a cathode. The anode and cathode design permit conductivity for the electro-deposition of the plating solution. The cathode of the brush plating system is attached to the connector body, and the anode is attached to a brush plating tool. Once the brush plating system is activated, the brush plating tool is then used to apply the plate coating material onto each of the contact pins 28 in situ within the connector body in one operation, without having to disconnect or re-set the system between each pin contact plating.

The contact pins 28 are also preferably cleaned prior to applying the brush plating thereon, in order to ensure a quality adhesion of the plating material. A suitable cleaning method and solution is chosen to ensure compatibility with the predetermined plating material and the pin contacts. Although gold plating is applied in one embodiment of the present invention, various other metallic plating coating materials may be used, such as nickel for example. The skilled reader will understand that modifications may be required, however, such as base metal activation before nickel application, for example. The method of brush plating provided by the present invention is thus employed in one embodiment to re-furbish the gold plating on the pin contacts of the electrical connector in situ therewithin.

Additionally, in order to prevent unwanted plating of the aluminum foil grounding member 32, the grounding member is preferably masked off by a protective coating prior to plating the pin contacts 28. In one embodiment, the aluminum foil grounding member is masked by a mica layer, which is applied thereon in situ following the insertion of the grounding member within the connector body, in order to prevent or at least reduce the possibility of applying coating material directly on the grounding member. The mica also provides protection against short circuit between the anode and the ground. Alternately, the grounding member can have a pre-applied protective layer thereon prior to the insertion thereof into the connector body. However, the grounding member must nevertheless provide exposed surfaces for direct contact with the pin contacts to ensure electrical flow communication therebetween is maintained, thereby ensuring that all of the pin contacts are grounded by the grounding member.

The above description is meant to be exemplary only, and one skilled in the art will recognize that changes may be made to the embodiments described without departing from the scope of the invention disclosed. For example, although gold and nickel plating is described above, other plating materials may be used to refurbish the connector contacts. Further, electrical contacts other than pin connectors can similarly be refurbished in situ by plating. Protective coating layers other than mica may also be used, provided they adequately cover the grounding member to prevent it from becoming coated by the plating material during the plating process. Still other modifications which fall within the scope of the present invention will be apparent to those skilled in the art, in light of a review of this disclosure, and such modifications are intended to fall within the appended claims.

We claim:

1. A method of plating contacts in situ within an electrical connector, the connector having a plurality of contacts provided at a base of a cavity defined within a connector body and circumscribed by a skirt thereof, the skirt extending from the base a greater distance than the contacts and defining an opening providing access to the cavity, the method comprising: inserting a grounding member into the cavity through the opening such that all of the contacts to be plated are interconnected in electrical flow communication by the grounding member; grounding the grounding member such that the contacts are commonly grounded; and applying a brush plated coating onto the contacts within the connector body.

2. The method as defined in claim 1, further comprising masking the grounding member with a protective coating to prevent the grounding member from being plated.

3. The method as defined in claim 2, further comprising masking the grounding member with a mica layer.

4. The method as defined in claim 3, further comprising applying the mica layer onto the grounding member prior to the brush plating step.

5. The method as defined in claim 1, wherein the grounding member is at least one electrically conductive foil sheet.

6. The method as defined in claim 5, wherein the foil sheet includes aluminum.

7. The method as defined in claim 1, further comprising cleaning the contacts prior to the brush plating step.

8. The method as defined in claim 1, wherein the contacts are pins.

9. A method of plating contact pins of an electrical connector in situ therewithin, the connector having a plurality of contact pins provided at a base of a cavity defined within a connector body and circumscribed by a skirt thereof, the skirt extending from the base a greater distance than the contacts and defining an opening providing access to the cavity, the method comprising: inserting a grounding member into the cavity through the opening such that the grounding member interconnects the contact pins to be plated in electrical flow communication; linking in electrical flow communication a cathode of a brush plating system with the grounding member; attaching an anode of the brush plating system to a brush plating tool; and using the brush plating tool to apply a plate coating onto the contact pins within the connector body.

10. The method as defined in claim 9, further comprising removing existing plate coating on the contact pins prior to the step of inserting the grounding member.

11. The method as defined in claim 9, further comprising masking the grounding member with a protective coating to prevent the grounding member from being plated.

12. The method as defined in claim 11, further comprising masking the grounding member with a mica layer.

13. The method as defined in claim 12, further comprising applying the mica layer onto the grounding member prior to the brush plating step.

14. The method as defined in claim 9, wherein the grounding member is at least one foil sheet.

15. The method as defined in claim 14, wherein the foil sheet includes aluminum.

16. The method as defined in claim 9, further comprising cleaning the contact pins prior to the brush plating step.

* * * * *